US008459736B1

(12) United States Patent
Begley, Jr.

(10) Patent No.: US 8,459,736 B1
(45) Date of Patent: Jun. 11, 2013

(54) POOLSIDE CHAIR AND ASSOCIATED USE THEREOF

(76) Inventor: Floyd A. Begley, Jr., LaGrange, GA (US)

( * ) Notice: Subject to any disclaimer, the term of this patent is extended or adjusted under 35 U.S.C. 154(b) by 235 days.

(21) Appl. No.: 12/881,280

(22) Filed: Sep. 14, 2010

(51) Int. Cl.
*A47C 3/30* (2006.01)

(52) U.S. Cl.
USPC ..... 297/217.7; 4/496; 297/344.19; 297/360

(58) Field of Classification Search
USPC ..... 297/27, 28, 217.7, 344.19, 359, 360, 297/451.5, 461; 4/496, 506
See application file for complete search history.

(56) References Cited

U.S. PATENT DOCUMENTS

| | | | | |
|---|---|---|---|---|
| 284,294 | A * | 9/1883 | Graves | 297/328 |
| 513,584 | A * | 1/1894 | Leisenring | 297/314 |
| 1,788,801 | A * | 1/1931 | Mintz | 297/354.12 |
| 3,591,112 | A | 7/1971 | Garhausen | |
| 4,257,582 | A * | 3/1981 | Wirges | 267/120 |
| 4,514,009 | A | 4/1985 | Vanderminden et al. | |
| 4,766,838 | A * | 8/1988 | Johnson | 114/363 |
| 4,903,926 | A * | 2/1990 | McNarry et al. | 248/214 |
| 5,090,770 | A * | 2/1992 | Heinrichs et al. | 297/344.19 |
| 5,590,619 | A * | 1/1997 | Meador et al. | 114/363 |
| 5,613,737 | A * | 3/1997 | Tseng | 297/463.1 |
| 5,636,649 | A * | 6/1997 | Horvath | 135/16 |
| 6,575,532 | B2 * | 6/2003 | Almerico | 297/344.26 |
| 6,860,567 | B1 | 3/2005 | Bauer | |
| 6,935,686 | B1 * | 8/2005 | Liao | 297/252 |
| 2008/0093902 | A1 | 4/2008 | Jones | |

OTHER PUBLICATIONS

Ace Bayou 51275 Wireless X Cooper Video Chair with Tilt and Swivel Base, Flip Arms. Amazon.com. http://www.amazon.com/Ace-Bayou-Wireless-Cooper-Swivel/dp/B001IKGWCQ. Accessed Jan. 8, 2010.

* cited by examiner

*Primary Examiner* — Peter Brown
(74) *Attorney, Agent, or Firm* — Montgomery Patent & Design, LLC; Robert C. Montgomery

(57) ABSTRACT

An adjustable poolside chair comprises a chair assembly, a height-adjustable support mechanism, and a weighted base. The chair assembly comprises an outdoor padded chair with a tilting back portion and is constructed of lightweight, waterproof materials. The weighted base comprises a pair of horizontally adjustable hooks which are extended around a lip of a pool. The base also comprises a pair of rollers for transportation of the chair. The adjustable support mechanism comprises a height adjustable pneumatic cylinder and also provides a swivel function. In use, the base is placed in a desired location and the hooks are extended around the lip of the pool and secured in place using tightening knobs, thereby providing additional stabilization of the chair in a poolside position.

12 Claims, 8 Drawing Sheets

POOLSIDE CHAIR AND ASSOCIATED USE THEREOF

RELATED APPLICATIONS

The present invention was first described in a notarized Official Record of Invention on Dec. 1, 2009, that is on file at the offices of Montgomery Patent and Design, LLC, the entire disclosures of which are incorporated herein by reference.

FIELD OF THE INVENTION

The present invention relates generally to seating arrangements, and in particular, to an adjustable chair particularly adapted for use in the vicinity of a swimming pool.

BACKGROUND OF THE INVENTION

Outdoor activities are particularly popular during the summer months. The warm weather is conducive to enjoying extended periods outside. An extremely popular warm weather activity is that of enjoying a swimming pool. Swimming pools are popular because of their reputation for providing comfort, recreation, cooling, and relaxation.

A primary attraction of swimming pools is that they allow various forms of enjoyment for different persons. While some people may enjoy active participation by entering the water for exercise, recreation, or simple in-water relaxation, many persons find the simple presence of the water to be enjoyable. Such people enjoy things such as watching other persons play, sitting or lying in the vicinity of water, and possibly simply dipping their feet in the water for cooling and comfort.

One (1) problem associated with pools is the difficulty of positioning for those people who do enjoy the poolside without actually entering the water. In many cases, such people may wish to gently enjoy the water while primarily relaxing out of water. However, these people are prone to inconveniences such as splashing water, need to move about in order to enjoy various aspects of the pool area, and the like.

Various attempts have been made to provide seating assemblies intended for waterside use. Examples of these attempts can be seen by reference to several U.S. patents. U.S. Pat. No. 3,591,112, issued in the name of Garmhausen, describes a boat seat clamp for use with a bench-type boat seat along an edge of a boat deck or the like.

U.S. Pat. No. 4,514,009, issued in the name of Vanderminden et al., describes a collapsible lounge chair with reclining features for easy transport and use in outdoor recreational areas.

U.S. Pat. No. 6,860,567, issued in the name of Bauer, describes a poolside lounge chair with cushioned portions and features of adjustable angle and curvature.

While these devices fulfill their respective, particular objectives, each of these references suffer from one (1) or more of the aforementioned disadvantages. Many such devices are not sufficiently adjustable for use at a poolside. Also, many such devices are not safe for use near the edge portions of a swimming pool. Furthermore, many such devices are not suited for a user to engage the water of a pool while lounging. Accordingly, there exists a need for a poolside chair without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide a poolside chair which allows a user to enjoy proximity to water while lounging, in a manner which accommodates users with varying sizes and preferences. Thus, the object of the present invention is to solve the aforementioned disadvantages and provide for this need.

To achieve the above objectives, it is an object of the present invention to comprise an ergonomic poolside chair to provide a comfortable and adjustable seating arrangement in the vicinity of a swimming pool. The apparatus comprises a chair assembly, a height adjusting assembly, and a base assembly.

Another object of the present invention is to comprise the chair assembly of waterproof padding portions suitable for extended use in proximity to water.

Yet still another object of the present invention is to allow the apparatus to rotate three-hundred sixty degrees (360°) via pivoting attachment of the chair assembly to the height adjusting assembly.

Yet still another object of the present invention is to provide vertical adjustment of the chair assembly height via the height adjusting assembly. The height adjusting assembly comprises a cylindrical pneumatic support unit which provides a means to vary the distance between the chair assembly and base assembly. The height adjusting assembly is manually adjustable via a side positioned lever.

Yet still another object of the present invention is to allow a user to selectively tilt a back portion of the chair assembly via relative rotational motioning of arm portions of the chair and opposing side surfaces of the back portion.

Yet still another object of the present invention is to provide secure, stable positioning of the apparatus via the weighted base assembly. The base assembly comprises a heavy rectangular portion. A bottom surface of the base assembly further comprises a high traction material in order to reduce skidding.

Yet still another object of the present invention is to allow a user to securely position the apparatus along a pool edge in order to facilitate hanging of feet into the pool while seated in the apparatus. The apparatus further comprises a pair of insertable hook appendages which securely engage the base portion and provide a means to grip a near edge of a swimming pool.

Yet still another object of the present invention is to facilitate transportation of the apparatus via a pair of rollers located along a rear edge of the base assembly. The rollers facilitate rolling transportion of the apparatus when tilted backwards by a user.

Yet still another object of the present invention is to provide a method of utilizing the device that provides a unique means of obtaining an instance of the apparatus, transporting it to a desired location for use, positioning the apparatus in a desired location via tilting the apparatus onto the rollers, tilting the apparatus in a desired location to securely engage a flat ground surface via the base assembly, engaging a nearby swimming pool edge via insertion and adjustment of the hook appendages if needed, rotating the chair assembly to a desired orientation, selectively tilting the back portion of the chair assembly, selectively adjusting the height of the chair to facilitate desirable positioning of a user's feet above the ground, on the ground, or within the water of a nearby pool, and relocating the apparatus as desired during periods of non-use.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
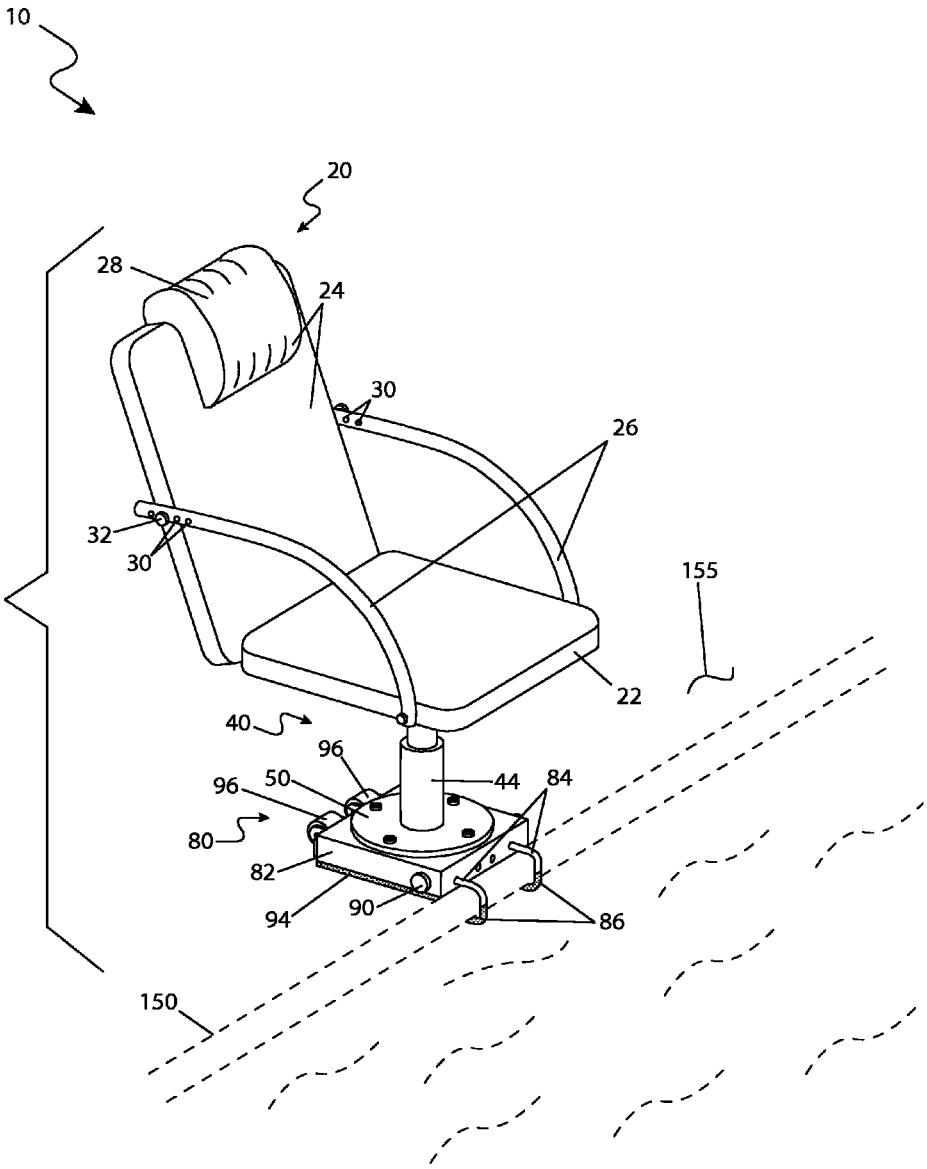
FIG. 1 is an environmental view of a poolside chair 10, according to a preferred embodiment of the present invention.

10 poolside chair
20 chair assembly
22 seat portion
24 back portion
26 arm
27 arm pivot
28 head rest
30 tilt aperture
31 threaded insert
32 first knob/stud fastener
33 covering
34 frame
36 padding
38 hinge
40 height adjusting assembly
42 upper cylinder
44 lower cylinder
46 swivel bearing
48 upper mounting plate
50 lower mounting plate
52 lever
54 lever bracket
55 lever pivot
56 first lever aperture
57 second lever aperture
59 valve
61 seal
62 bushing
64 shaft
80 base assembly
82 platform
84 hook appendage
86 hook tip portion
88 hook orifice
90 second knob/stud fastener
92 hook stowing orifice
94 non-skid pad
96 roller
97 first roller bracket
98 second roller bracket
100 fastening means
105 fastener aperture
110 threaded hole
150 swimming pool structure
155 swimming pool deck

DETAILED DESCRIPTION OF THE PREFERRED EMBODIMENT

The best mode for carrying out the invention is presented in terms of its preferred embodiment, herein depicted within FIGS. 1 through 5*c*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, an environmental view of a poolside chair 10, according to a preferred embodiment of the present invention, is disclosed. The present invention describes a poolside chair (herein described as the "apparatus") 10, which comprises a comfortable chair assembly 20, a height adjusting assembly 40, and a weighted base assembly 80. The chair assembly 20 comprises conventional seat 22 and back 24 portions made using waterproof padded construction with a tilting back portion 24 (see FIGS. 2 and 3). The height adjusting assembly 40 connects the base assembly 80 and the chair assembly 20 along a vertical center line while providing both swiveling and vertically adjustable functions. The base assembly 80 is weighted for stability and comprises a pair of extendable and lockable hook appendages 84 which wrap around an edge region of a pool structure 150 to affix the apparatus 10 thereto.

Figure 2A:
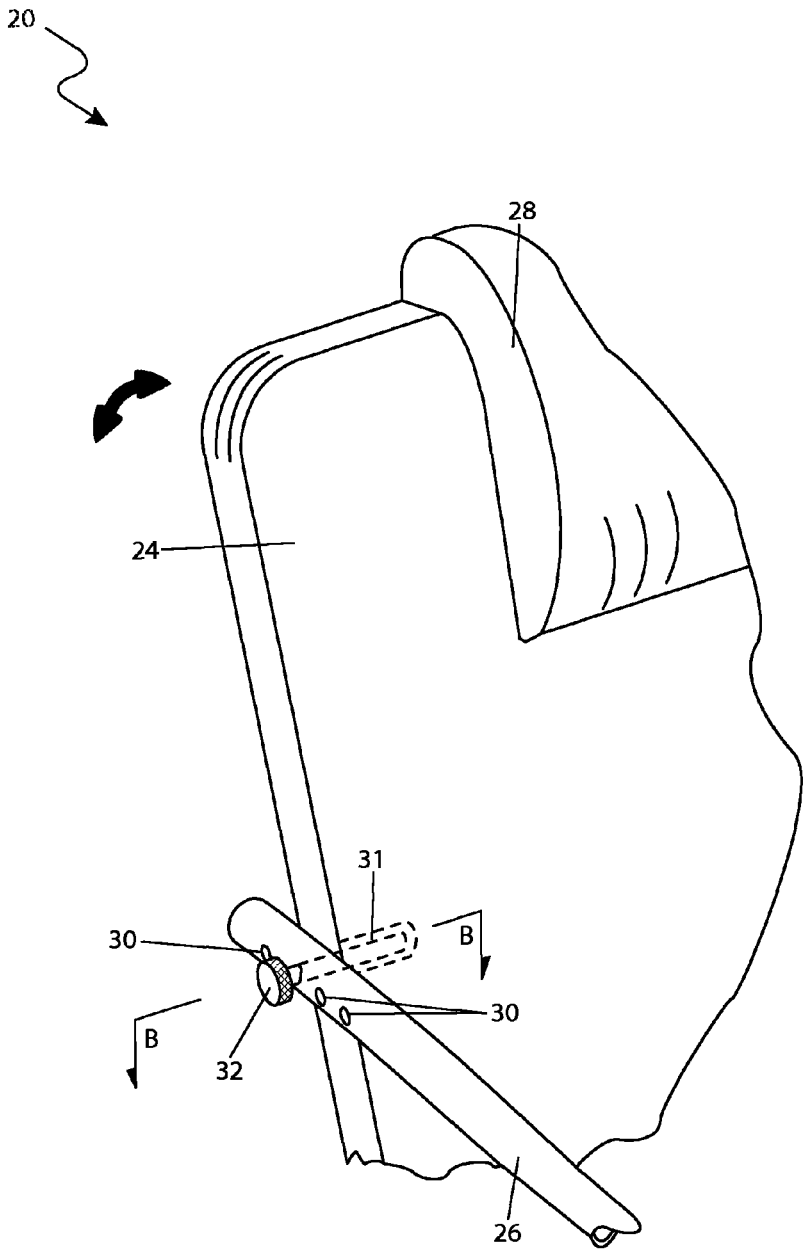
FIG. 2*a* is a close-up view of an adjustable arm portion 26 of the poolside chair 10, according to a preferred embodiment of the present invention.
Figure 2B:
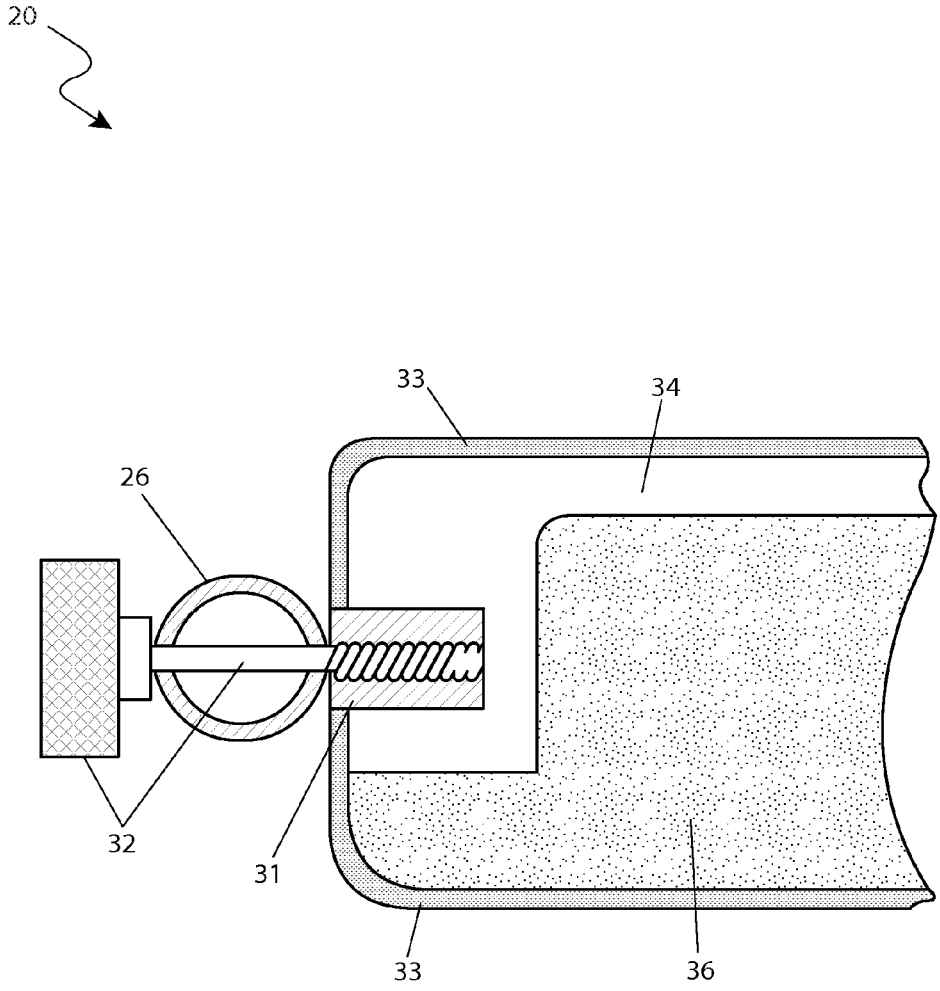
FIG. 2*b* is a section view of the adjustable arm portion 26 of the poolside chair 10 taken along section line B-B (see FIG. 2*a*), according to a preferred embodiment of the present invention.

Referring now to FIGS. 2*a* and 2*b*, close-up and section views of the adjustable arm portion 26 of the poolside chair 10, according to a preferred embodiment of the present invention, are disclosed. The chair assembly portion 20 of the apparatus 10 comprises a pair of arcuate tubular arm portions 26 for resting one's arms upon. End portions of said arm portions 26 are affixed to the seat 22 and back 24 portions of the chair assembly 20 via respective arm pivots 27 (see FIG. 3), and adjustable first knob/stud fasteners 32. Said arm portions 26 provide a means to variably tilt the back portion 24 via an angularly adjustable connection between said arm portions 26 and opposing side surfaces of said back portion 24. Said connection of each arm 26 to the back portion 24 comprises a plurality of integral tilt apertures 30, a threaded insert 31, and a first knob/stud fastener 32. A desired backwardly tilting angle of the back portion 24 may be secured in position by inserting a stud portion of the first knob/stud fasteners 32 through an aligned tilt aperture portion 30 of the arm 26, and subsequently being threadingly engaged into a threaded insert 31 being correspondingly located and stationarily mounted to the frame portion 34 within opposing side surfaces of the back portion 24. The first knob/stud fasteners 32 comprise common knurled knobs with integral threaded studs. The rear edge of the seat portion 22 is rotatingly affixed to the bottom edge of the seat back portion 24 via a pair of common axial hinges 38 being arranged in a linear manner as seen in FIG. 3.

Figure 3:
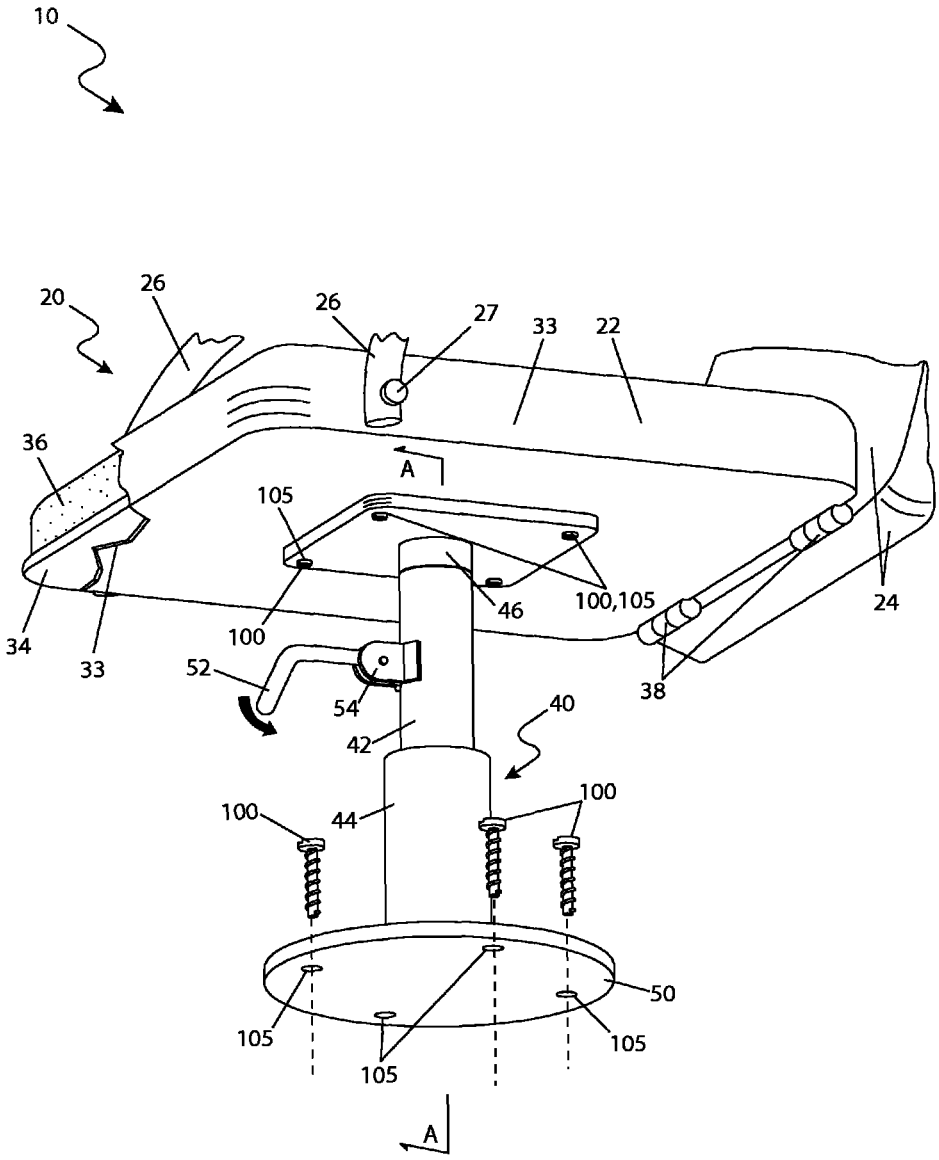
FIG. 3 is a perspective view of a height adjusting assembly portion 40 of the poolside chair 10, according to a preferred embodiment of the present invention.
Figure 4:
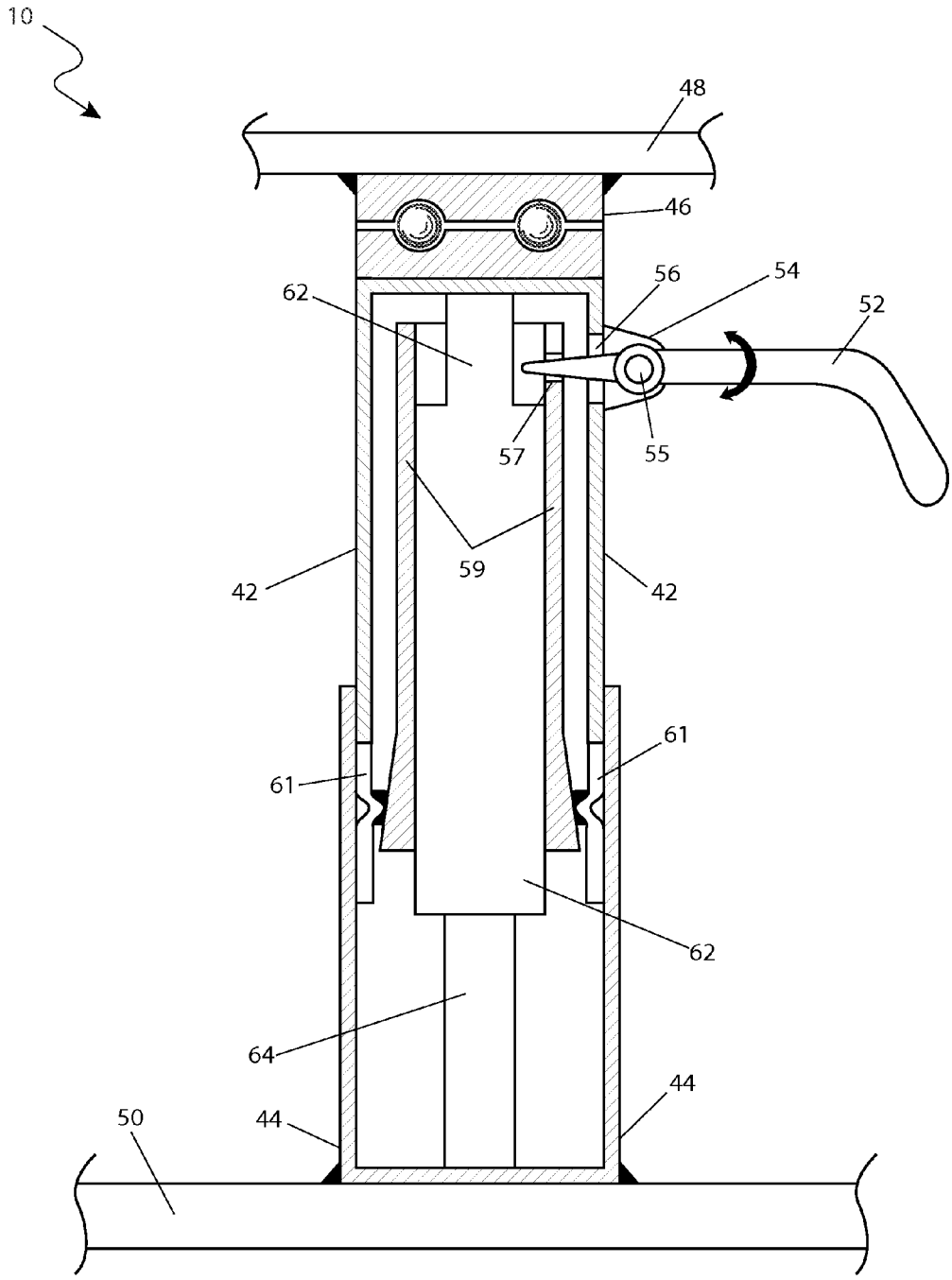
FIG. 4 is a section view of the height adjusting assembly portion 40 of the poolside chair 10 taken along section line A-A (see FIG. 3), according to a preferred embodiment of the present invention.

Referring now to FIGS. 3 and 4, perspective and section views of the height adjusting assembly portion 40 of the apparatus 10, according to a preferred embodiment of the present invention, are disclosed. The apparatus 10 comprises an upper cylinder 42 and a lower cylinder 44 affixed between an upper mounting plate 48 and a lower mounting plate 50. The height adjusting assembly 40 is affixed to and extends from a top surface of the base assembly 80 to a center bottom surface of the chair assembly 20 while providing both swiveling and vertically adjustable functions to the apparatus 10. The height adjusting assembly 40 comprises a cylindrical pneumatic support unit envisioned to be similar to manually adjustable mechanisms commonly used in office chair designs. The height adjusting assembly 40 provides a full three-hundred sixty (360) degrees of swiveling motion and approximately six (6) to eight (8) inches of vertical adjustment of a distance between the chair assembly 20 and a supporting surface such as a swimming pool deck 155 or the like.

The upper mounting plate 48 and lower mounting plate 50 comprise rugged plastic or metal circular plates being permanently affixed thereto top and bottom surfaces of the height adjusting assembly 40 using welding or equivalent strong fastening methods. The upper 48 and lower 50 plates extend horizontally outward from upper 42 and lower 44 cylinder portions, being parallel to and providing an attachment means to respective chair 20 and base 80 assemblies using common fastening means 100 such as rivets, screws, bolts, and corresponding fastener apertures 105.

The height adjusting assembly 40 provides a pneumatic lifting means via the upper cylinder 42, a lower cylinder 44, and an activation lever 52. The upper cylinder 42 is snuggly inserted downwardly into the lower cylinder 44 in a telescoping manner to enable height adjustment of the chair assembly 20 by a user by motioning the lever 52 upwardly, thereby allowing a user to change an amount of air entrapped within. The lever 52 is pivotingly affixed to an outer surface of the upper cylinder 42 via an integral "U"-shaped lever bracket 54 and a pivot pin 55. An end portion of the lever 52 extends horizontally and protrudes through a first lever aperture 56 of the upper cylinder 42 located along a side surface, and subsequently protrudes through a second lever aperture 57 of a valve 59 located internally within the upper cylinder 42. The valve 59 comprises a hollow vertical sliding cylinder which further comprises an annular rubber seal 61 along a bottom perimeter edge which provides an airtight sliding seal against an inner bore of the lower cylinder 44. As the lever 52 is released downwardly, the valve 59 is motioned upwardly, thereby causing the seal portion 61 of the valve 59 to trap a volume of air within the lower cylinder 44. The trapped air acts to support the upper cylinder 42 and the attached chair assembly 20. The valve 59 and seal 61 are accurately guided along a vertical axis via a guiding bushing 62 and shaft 64 set positioned along a vertical center line. The valve 59 is motioned vertically as the lever 52 is manipulated to allow a volume of air to pass out of or into the lower 44 cylinder, thereby positioning the upper cylinder 42 and chair assembly 20 at a user selected height. However, the height adjusting assembly 40 is not limited to the illustrated embodiment, and a person skilled in the art will appreciate that many other embodiments of the height adjusting assembly 40 are possible without deviating from the basic concept and as such should not be interpreted as a limiting factor of the apparatus 10.

The upper cylinder portion 42 of the height adjusting assembly 40 provides an integral swivel bearing 46 located within a top portion of said upper cylinder 42. The swivel bearing 46 allows a user to rotate the chair assembly 20 a full three-hundred sixty degrees (360°). Said swivel bearing 46 is envisioned to comprise a rugged thrust-type ball-bearing unit envisioned to comprise an aesthetic matching profile with that of the upper cylinder 42.

The seat 22 and back 24 portions of the chair assembly 20 comprise rectangular padded water-resistant members further comprising a vinyl or plastic outer covering 33, a thickness of padding material 36, and an internal plastic or wood flat panel frame 34. The padding 36 is envisioned to be made using a common urethane foam rubber being located between the frame portions 34 and the water-resistant covering 33 providing expected comfort to the user during normal use of the apparatus 10. Said seat 22 and back 24 portions are envisioned to be manufactured using conventional furniture and textile assembly methods common in the industry and are to be introduced in various decorative colors and patterns.

Figure 5A:
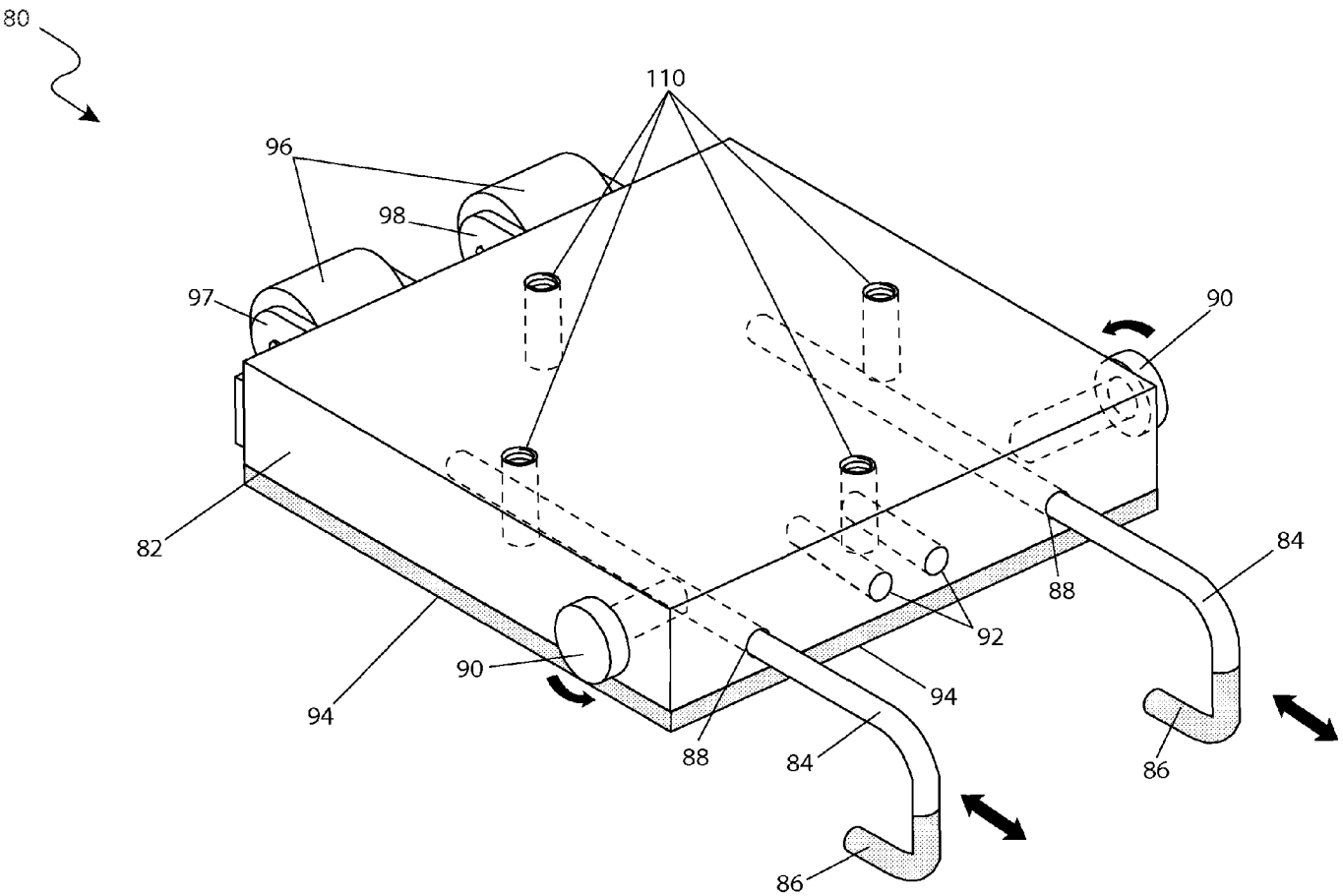
FIG. 5*a* is a front perspective view of a base assembly portion 80 of the poolside chair 10 depicting deployment of hook appendage portions 84, according to a preferred embodiment of the present invention.
Figure 5B:
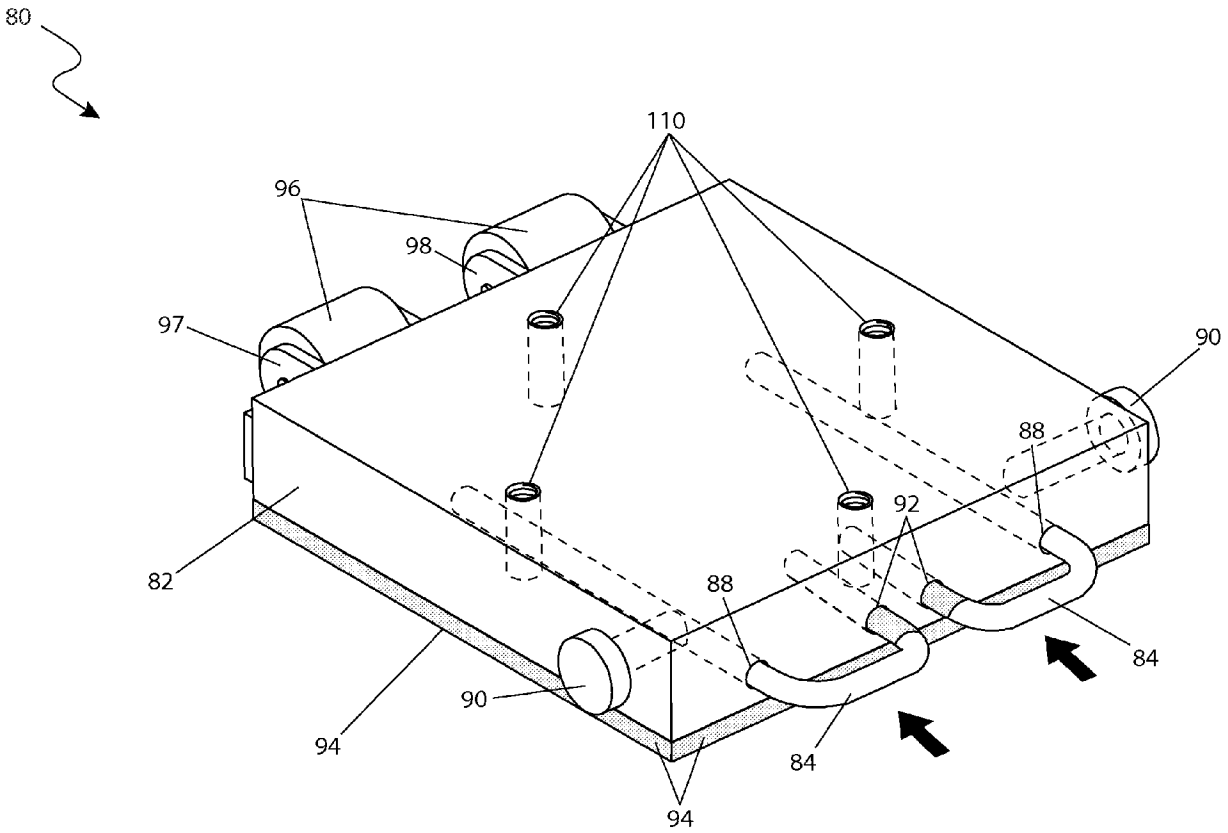
FIG. 5*b* is a front perspective view of a base assembly portion 80 of the poolside chair 10 depicting a stowed state of said hook appendage portions 84, according to a preferred embodiment of the present invention; and, FIG. 5*c* is a rear perspective view of a base assembly portion 80 of the poolside chair 10 depicting roller portions 96, according to a preferred embodiment of the present invention.
Figure 5C:
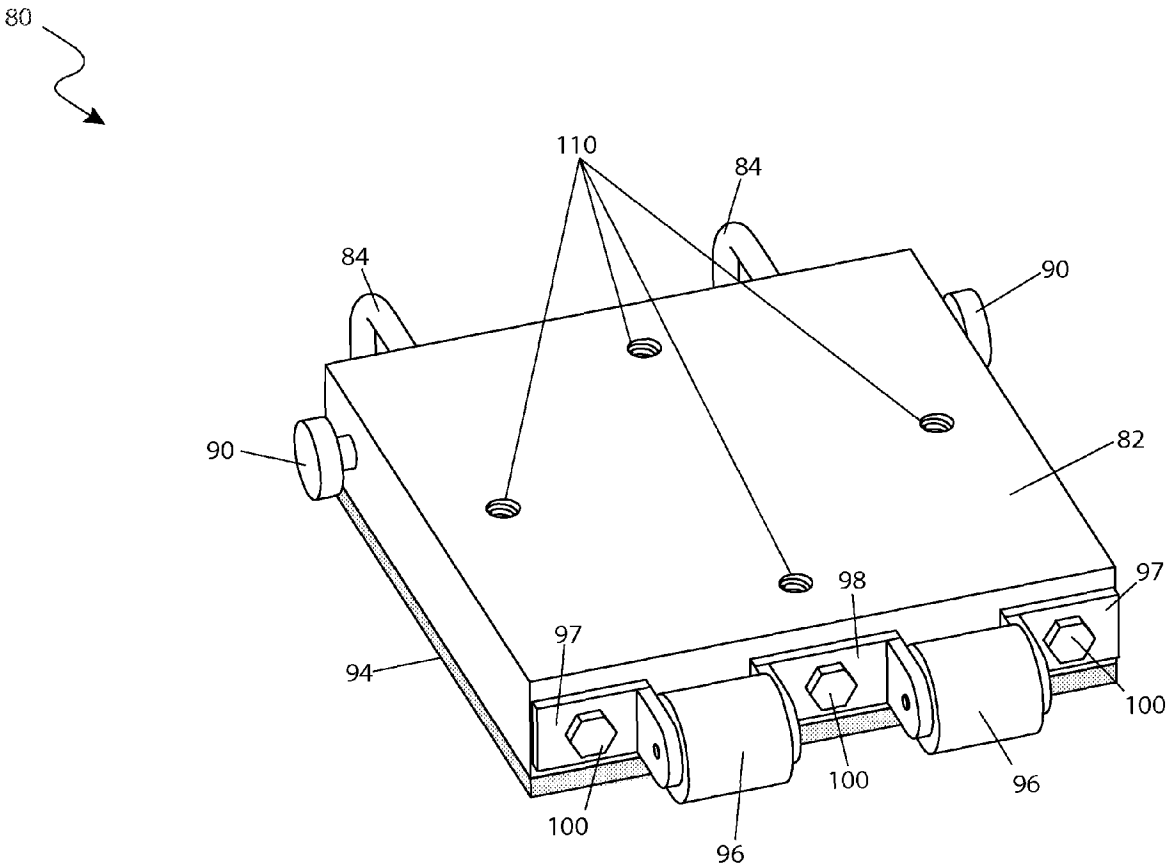

Referring now to FIGS. 5*a*, 5*b*, and 5*c*, various perspective views of the base assembly portion 80 of the apparatus 10, according to a preferred embodiment of the present invention, are disclosed. The base assembly 80 comprises a rectangular platform 82, a pair of hook appendages 84, a pair of tightening knobs 90, and a pair of rollers 96. The base assembly 80 comprises a heavily weighted rectangular platform 82 weighing approximately twenty (20) pounds and having a pair of extendable and lockable hook appendages 84 which wrap around an edge region of a pool structure 150, thereby stabilizing the apparatus 10 upon a swimming pool deck 155 (see FIG. 1). The rectangular platform 82 is to be approximately ten (10) to twelve (12) inches in length on each side and approximately three (3) inches in height. The platform 82 further comprises a non-skid pad 94 affixed to a bottom surface using common industrial adhesives to stabilize the apparatus 10 upon said swimming pool deck 155 surface during normal use. Said non-skid pad 94 is envisioned being made of a durable sheet rubber material. The platform 82 provides an attachment means to the aforementioned lower mounting plate portion 50 via four (4) threaded holes 110 using common fastening means 100. The threaded holes 110 are arranged along a top surface of said platform 82 being correspondingly positioned with regards to the fastener aperture portions 105 of said lower mounting plate 50 (see FIGS. 1 and 3).

The platform 82 provides a means to secure the apparatus to an edge portion of the swimming pool structure 150 via a pair of arcuate hook appendages 84. The platform 82 provides an insertable attachment means thereto said hook appendages 84 via a pair of round hook orifices 88 located along a front surface being sized so as to slidingly receive a distal end portion of said hook appendages 84. Each hook appendage 84 comprises a straight distal portion and a proximal arcuate portion which curves downwardly forming an approximate arc of two-hundred (200) degrees being formed so as to conform to an edge portion of a swimming pool structure 150. Each hook appendage 84 further comprises a rubberized or plastic coated proximal hook tip portion 86 providing protection to the swimming pool structure 150 against scratching or ripping of pool liners or other fragile portions. Once hooked around an edge portion of the swimming pool structure 150, the hook appendages 84 are axially and longitudinally locked in position via respective second knob/stud fasteners 90 comprising common knurled knobs with integral threaded studs. Said second knob/stud fasteners 90 are threadingly engaged into opposing side portions of the platform 82 so as to internally intersect a respective hook appendage 84 at a right angle, thereby applying a clamping and locking pressure.

Said platform 82 also provides a means to discreetly stow the hook appendages 84 when not being used via a pair of hook stowing orifices 92 located between the aforementioned hook orifices 88. Said hook stowing orifices 92 are sized to insert and secure the hook tip portions 86.

The base assembly 80 also comprises a pair of rollers 96 located along a rear edge enabling easy transportation and relocation of the apparatus 10. The rollers 96, as illustrated in FIG. 3, are supported and aligned along a single axis by a pair of outwardly positioned first roller brackets 97 and a centrally positioned second roller bracket 98. The brackets 97, 98 captivate the rollers 96 and are affixed to rear vertical surface of the platform 82 using a common fastening means 100 such as screws or bolts. The brackets 97, 98 also provide axle-like features being rotationally engaged through a center portion of the rollers 90. The rollers 90 are envisioned to be made using a hard plastic or metal material. During use, the rollers 90 are positioned slightly above a surface of the swimming pool deck 155. As the apparatus 10 is tilted backward, said rollers 90 contact the surface of the deck 155. Once tilted backward, the weight of the apparatus 10 is transferred from the platform 82 onto the rollers 90, thereby providing easy rolling of the apparatus 10 to a different location in a similar fashion as motivating a common hand-truck device.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: procuring a model of the apparatus 10 having a desired exterior color or pattern; placing the apparatus 10 in a desired location along an edge area of a swimming pool deck 155; extending the hook appendages 84 outwardly from the hook orifices 88; positioning the hook appendages 84 around a lip portion of the swimming pool structure 150; securing the hook appendages 84 in position by tightening the second knob/stud fasteners 90; adjusting a height of the chair assembly 20 by lifting the lever 52 and applying or removing one's weight to the seat portion 22 until obtaining a desired height; releasing the lever 52 to secure the chair assembly 20 at a desired height; adjusting an angle of the back portion 24 of the chair assembly 20 by unscrewing and removing the two (2) first knob/stud fasteners 32 from the arms 26; tilting the back portion 24 to a desired angle; reinstalling the first knob/stud fasteners 32 through the tilt apertures 30 and into the threaded insert portions 31 of each arm 26; and, enjoying the portability and stability of the apparatus 10 while being seated at an edge of one's pool structure 150.

The apparatus 10 may also be utilized at various locations away from the swimming pool structure 150 in a similar manner as a normal free-standing chair by performing the following additional steps: loosening the second knob/stud fasteners 90; rotating the hook appendages 84 inwardly toward each other; pushing the hook appendages 84 toward the platform 82 such that the hook tip portions 86 are inserted into the hook stowing orifices 92; retightening the second knob/stud fasteners 90 to secure the hook appendages 84 in the stowed position; tilting the apparatus 10 rearwardly to transfer a weight of the apparatus 10 onto the rollers 96; wheeling the apparatus 10 to a desired location; adjusting the height of the height adjusting assembly 40 and an angle of the back portion 24 as previously described; and, utilizing the apparatus 10 in a similar manner as a normal chair.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A poolside chair for providing additional stabilization when positioning said pool side chair around a lip of a swimming pool, said poolside chair comprising:

a chair assembly, comprising:

a seat;

a back portion adjustably affixed to said seat;

a plurality of adjustable arms attached to said back portion and said seat, each comprising a plurality of tilt apertures, a first fastener having a knob and a threaded stud, and an arm pivot;

a plurality of hinges arranged in a linear manner along a rear bottom edge of said seat and said back portion; and, a plurality of threaded inserts affixed to opposing side surfaces of said back portion;

a height adjusting assembly; and, a base assembly, comprising:

a platform having a plurality of hook orifices located along a front surface of said platform;

a plurality of extendable and lockable hook appendages having hook tip portions;

a plurality of hook stowing orifices; and, a plurality of second fasteners threadingly engaged to opposing side portions of said platform;

wherein said adjustable arms are capable of variably tilting and locking said back portion at alternate positions relative to said seat;

wherein said adjustable arms are connected to said back portion by said first fasteners positioned through corresponding ones of said tilt apertures and said threaded inserts of said back portion;

wherein end portions of said adjustable arms are affixed to said seat and said back portion through said arm pivots and said first fasteners respectively;

wherein said hook appendages are stowed through said hook stowing orifices;

wherein said platform and said hook appendages are adapted to be wrapped around an edge region of a pool structure to stabilize said poolside chair upon a swimming pool deck;

wherein said hook appendages are axially and longitudinally locked in position through said second fasteners;

wherein said second fasteners intersect said hook appendages at a right angle thereby clamping and locking said hook appendages; and, wherein said height adjusting assembly is affixed to said base assembly, said height adjusting assembly being connected to said chair assembly in such a manner that said chair assembly swivels 360° as well as capable of being vertically adjusted.

2. The poolside chair of claim 1, wherein said height adjusting assembly comprises:

an upper mounting plate;

an upper cylinder including:

a first lever aperture, and, a lever bracket located along a side surface of said upper cylinder;

a lower cylinder;

a lower mounting plate;

a lever pivotably affixed through said lever bracket;

a vertically-sliding hollow cylinder valve having a second lever aperture formed therein;

an annular seal positioned along a bottom perimeter edge of said valve and located internally within said upper cylinder; and, a swivel bearing attached to said upper cylinder and said upper mounting plate respectively.

3. The poolside chair of claim 2, wherein an end portion of said lever horizontally extends and protrudes through said first and second lever apertures;

wherein said upper cylinder is snuggly inserted downwardly into said lower cylinder in a telescoping manner when said lever is motioned upwardly to change an amount of air entrapped within said upper cylinder; and, wherein, when said lever is released downwardly, said valve is motioned upwardly to cause said seal portion to trap a volume of air within said lower cylinder and thereby support said upper cylinder.

4. The poolside chair of claim 2, further comprising: a guiding bushing and a shaft positioned along a vertical center line of said upper cylinder and said lower cylinder respectively;

wherein said valve and said seal are guided along a vertical axis through said guiding bushing and said shaft respectively; and, wherein said valve is vertically motioned when said lever is manipulated to allow a volume of air to pass through said lower cylinder.

5. The poolside chair of claim 1, wherein each of said hook appendages comprises: a straight distal portion and an arcuate proximal portion which curves downwardly forming an arc of approximately two-hundred degrees and thereby adapted to conform to an edge portion of the pool structure.

6. The poolside chair of claim 1, further comprising:

a plurality of outwardly positioned first roller brackets and a centrally positioned second roller bracket affixed to a rear vertical surface of said platform; and, a plurality of rollers located along a rear edge of said platform and supported by said first roller brackets as well as said second roller bracket;

wherein said rollers are aligned along an axis.

7. A poolside chair for providing additional stabilization when positioning said pool side chair around a lip of a swimming pool, said poolside chair comprising:

a chair assembly, comprising:

a seat;

a back portion adjustably affixed to said seat;

a plurality of adjustable arms attached to said back portion and said seat each comprising a plurality of tilt apertures, a first fastener having a knob and a threaded stud, and an arm pivot;

a plurality of hinges arranged in a linear manner along a rear bottom edge of said seat and said back portion; and, a plurality of threaded inserts affixed to opposing side surfaces of said back portion;

a height adjusting assembly; and, a base assembly, comprising:

a platform having a plurality of hook orifices located along a front surface of said platform;

a plurality of extendable and lockable hook appendages having hook tip portions;

a plurality of hook stowing orifices; and, a plurality of second fasteners threadingly engaged to opposing side portions of said platform;

wherein said adjustable arms are capable of variably tilting and locking said back portion at alternate positions relative to said seat;

wherein said adjustable arms are connected to said back portion by said first fasteners positioned through corresponding ones of said tilt apertures and said threaded inserts of said back portion;

wherein end portions of said adjustable arms are affixed to said seat and said back portion through said arm pivots and said first fasteners respectively;

wherein said hook appendages are stowed through said hook stowing orifices;

wherein said platform and said hook appendages are adapted to be wrapped around an edge region of a pool structure to stabilize said poolside chair upon a swimming pool deck;

wherein said hook appendages are axially and longitudinally locked in position through said second fasteners;

wherein said second fasteners intersect said hook appendages at a right angle thereby clamping and locking said hook appendages; and, wherein said height adjusting assembly is affixed to said base assembly and extends upwardly therefrom, said height adjusting assembly being connected to said chair assembly in such a manner that said chair assembly swivels 360° as well as capable of being vertically adjusted.

8. The poolside chair of claim 7, wherein said height adjusting assembly comprises:

an upper mounting plate;

an upper cylinder including:

a first lever aperture, and, a lever bracket located along a side surface of said upper cylinder;

a lower cylinder;

a lower mounting plate;

a lever pivotably affixed through said lever bracket;

a vertically-sliding hollow cylinder valve having a second lever aperture formed therein;

an annular seal positioned along a bottom perimeter edge of said valve and located internally within said upper cylinder; and, a swivel bearing attached to said upper cylinder and said upper mounting plate respectively.

9. The poolside chair of claim 8, wherein an end portion of said lever horizontally extends and protrudes through said first and second lever apertures;

wherein said upper cylinder is snuggly inserted downwardly into said lower cylinder in a telescoping manner when said lever is motioned upwardly to change an amount of air entrapped within said upper cylinder; and, wherein, when said lever is released downwardly, said valve is motioned upwardly to cause said seal portion to trap a volume of air within said lower cylinder and thereby support said upper cylinder.

10. The poolside chair of claim 8, further comprising: a guiding bushing and a shaft positioned along a vertical center line of said upper cylinder and said lower cylinder respectively;

wherein said valve and said seal are guided along a vertical axis through said guiding bushing and said shaft respectively; and, wherein said valve is vertically motioned when said lever is manipulated to allow a volume of air to pass through said lower cylinder.

11. The poolside chair of claim 7, wherein each of said hook appendages comprises: a straight distal portion and an arcuate proximal portion which curves downwardly forming an arc of approximately two-hundred degrees and thereby adapted to conform to an edge portion of the pool structure.

12. The poolside chair of claim 7, further comprising:

a plurality of outwardly positioned first roller brackets and a centrally positioned second roller bracket affixed to a rear vertical surface of said platform; and, a plurality of rollers located along a rear edge of said platform and supported by said first roller brackets as well as said second roller bracket;

wherein said rollers are aligned along an axis.

* * * * *